US008887474B1

(12) United States Patent
Clark et al.

(10) Patent No.: US 8,887,474 B1
(45) Date of Patent: Nov. 18, 2014

(54) METHOD OF CREATING AN INTERIOR WALL PANEL

(71) Applicant: SFC, LLC, Toledo, OH (US)

(72) Inventors: Thomas D. Clark, Bonita Springs, FL (US); Kenneth J. Celski, Temperance, MI (US)

(73) Assignee: SFC, LLC, Toledo, OH (US)

( * ) Notice: Subject to any disclaimer, the term of this patent is extended or adjusted under 35 U.S.C. 154(b) by 0 days.

(21) Appl. No.: 14/031,434

(22) Filed: Sep. 19, 2013

Related U.S. Application Data

(60) Provisional application No. 61/702,806, filed on Sep. 19, 2012.

(51) Int. Cl.
*B44F 9/00* (2006.01)

(52) U.S. Cl.
USPC ..... 52/745.19; 52/741.1; 358/448; 358/452; 345/641

(58) Field of Classification Search
USPC ..... 52/745.19, 741.1, 745.05, 745.09; 101/483, 494, 487–488, 486, 490; 345/418–421, 429–430, 629–630, 641, 345/664, 679, 582; 358/448, 450, 452–453; 395/102, 117, 135; 703/1; 706/10
See application file for complete search history.

(56) References Cited

U.S. PATENT DOCUMENTS

| | | | | |
|---|---|---|---|---|
| 6,354,212 | B1 * | 3/2002 | Krinsky | 101/483 |
| 6,389,773 | B1 * | 5/2002 | Reuter et al. | 52/582.2 |
| 6,404,424 | B1 * | 6/2002 | Davis | 345/418 |
| 7,250,216 | B2 * | 7/2007 | Taylor | 428/423.7 |
| 7,999,825 | B2 * | 8/2011 | Webb et al. | 345/594 |
| 8,630,442 | B2 * | 1/2014 | Connell | 382/100 |
| 2005/0194106 | A1 * | 9/2005 | Scales | 160/201 |
| 2013/0011633 | A1 * | 1/2013 | Perry | 428/195.1 |

* cited by examiner

*Primary Examiner* — Jeanette Chapman
(74) *Attorney, Agent, or Firm* — Marshall & Melhorn, LLC

(57) ABSTRACT

A method for creating an interior wall panel, such as for a residential structure, is described. The method includes providing an electronic template for an interior wall. The template may define at least one interior wall opening. At least one feature for all or part of the wall is selected. The feature may be such a color, design and/or pattern. The feature is imaged on a first substrate when the interior wall opening is imaged. A second substrate may be similarly imaged. The imaged substrates are located adjacent one another on an interior wall of a residential structure. The interior wall opening is removed to accommodate a feature on the interior wall.

21 Claims, 3 Drawing Sheets

METHOD OF CREATING AN INTERIOR WALL PANEL

RELATED APPLICATIONS

The present application claims priority to and the benefit of U.S. Provisional Patent Application 61/702,806 filed on Sep. 19, 2012 which is fully incorporated by reference herein.

BACKGROUND OF THE INVENTION

It is well-known that interior spaces for offices, residences and recreational-type vehicles are finished with interior walls. The walls typically comprise drywall, wood or wood paneling.

In the case of recreational vehicles, the interior walls used to be fairly utilitarian. This may have been due to a desire to save money and time in their manufacture and construction, and also to achieve weight savings and minimize fuel consumption for the vehicle.

Over time, recreational vehicles have become more and more home-like in their appearance and finishes. Consumer demand for higher quality finishes and appearances requires manufactures to continue to improve their products. In some cases, recreational vehicles can be lavish, utilize expensive materials and have a high degree of design and craftsmanship.

Manufacturers are thus faced with a problem between consumers demanding higher quality products with improved appearances and yet still being able to offer a product that most consumers can afford, that will sell and that minimizes fuel consumption.

For a wall covering, current vehicles might utilize a plywood sheet covered with a laminate material. Typically, plywood sheets come in four foot by eight foot sections. These sections must be connected together, such as by framing within the vehicle. The plywood sheets and their resulting framing can add a tremendous amount of weight to the vehicle if they comprise the wall covering around most of the vehicle interior perimeter.

The laminate material is typically purchased by the recreational vehicle manufacturer in very large quantities, and the bulk purchase reduces the cost to the manufacturer. The manufacturer applies the same laminate material across all, or most, of the walls requiring covering. Thus, the end users see the same type of material throughout the entire interior. For example, the same laminate material appears in the living area, the kitchen area, the bathroom area and the bedroom area. Consumers consider the use of the same material in more than one area drab and boring.

Typically, the laminate material is applied with an adhesive material to the plywood. The adhesive material adds some weight to the vehicle because of the large amount needed to connect the laminate to the plywood across most of the vehicle. The adhesive has to be applied, sometimes manually, which adds to the vehicle cost, as well as the time to manufacture the vehicle.

In view of the foregoing problems with the prior art, it would be preferable to utilize a lightweight material that is easy to manipulate and install. It would also be advantageous if the material possessed a high quality appearance that was customizable according to consumer preference.

SUMMARY OF THE INVENTION

A method of creating an interior wall panel, such as for a residential structure, begins with providing an electronic template for an interior wall of the structure. The template may define at least one interior wall opening. At least one feature is selected for all or part of the wall. The at least one feature is selected from the group of a color, a design and a pattern. The at least one feature is imaged on all or part of a first substrate. The at least one feature may be imaged at the same time that the at least one interior wall opening is imaged on the substrate. Another at least one feature may be imaged on a second substrate. The imaged substrates are located adjacent one another on the interior wall of the residential structure. The area defined for the interior wall opening is removed.

The present invention is designed to overcome the significant disadvantages associated with the prior art designs. The present invention is designed to save manufacturers time and money in materials and manufacturing. The resulting cost savings can be passed onto consumers. Additionally, the present invention is designed to be lighter weight than the prior art designs. When installed in a camper, recreational vehicle, mobile home or even modular home, the reduced weight can result in decreased fuel consumption when the vehicle or home is moved from place to place. Further, the present invention permits manufacturers and consumers a large range of colors, designs and patterns for the vehicle interior so that the living space, the kitchen area, the bathroom area and the bedroom area (for example) can have varied colors, designs and patterns in a cost effective manner.

DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined herein. Hence, specific dimensions, directions or other physical characteristics relating to the embodiments disclosed are not to be considered as limiting, unless expressly stated otherwise.

The present invention comprises a substrate 10, such a fiberglass reinforced panel, or FRP. Such panels are well-known products for being readily available, low cost, crack and mildew resistant, relatively high strength even with temperature variations, easy to cut and manipulate, available in various shapes and sizes and for being lightweight. While FRP may be a preferred material, others with similar or the same properties and/or characteristics may be used.

The size, shape and elements associated with the vehicle or home where the wall is to be installed must be known. A template 12 of the area where the wall is to be installed is either made or obtained.

Figure 1:
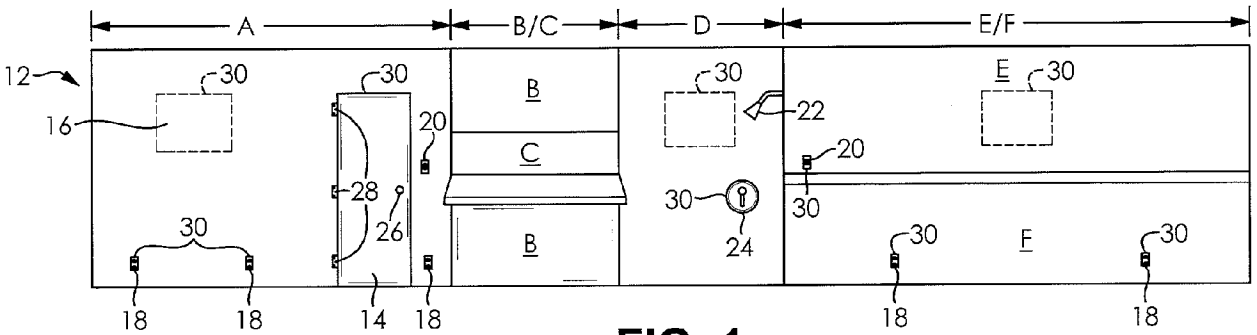
FIG. 1 is a schematic representation of a blank template for one type of interior wall.

An example of a template 12 for an interior wall is depicted in FIG. 1. It should be appreciated that the template 12 in FIG. 1 is merely an example and that the present invention is not limited to the depicted template 12. Instead, templates 12 of all shapes, sizes, and containing greater or fewer features and/or interior wall openings 30 may be part of the present invention.

The template 12 is a detailed and dimensioned drawing identifying, by way of example, where doors 14 and/or windows 16 will be located, where electrical outlets 18 and switches 20 will be located, where plumbing fixtures, such as shower heads 22, faucets (not shown) and faucet handles 24 will be located and where door handles 26 and hinges 28 will be located. The template 12 may also include information where particular spaces begin and end. The foregoing are collectively referred to as interior wall openings 30. The spaces are described in more detail below.

If the template 12 is to be made, it can be made by measuring the size, shape and location of the interior wall openings 30 and then drawing a scale version of the wall on a computer or on paper. Templates 12 can also be provided in electronic or hard copy form by the vehicle manufacturer.

It can be appreciated from the example provided above that the template 12 may represent a substantial length along the wall. The template 12 may be divided into sections A-F according to areas within the exemplary structure. While areas A-F are noted in the template 12 above, greater or fewer areas, and/or areas of different shapes and sizes may be used.

In FIG. 1, section A may be a living space, section B/C may be a kitchen space, section D may be a bathroom and/or shower space and section E/F may be a bedroom. As indicated above, the order, size, shape, and/or number of the sections can be changed. Further, it can be appreciated that FIG. 1 depicts one wall of the vehicle or home. A template 12, such as depicted in FIG. 1, can be used for any and all walls of the vehicle or home.

It is preferable to include a feature on the substrate 10 since typically substrates, such as FRP, are solid white in color and do not have any design or pattern on them. If the substrate 10 is to be used as an interior wall of a recreational vehicle, a mobile home, or a modular home it is preferred that a feature be included on the substrate 10.

It may be desirable for adjacent walls, sections or areas to have complimentary features. For example, in FIG. 1 section E/F might be used in a bedroom area. Only one wall of the bedroom area is depicted in FIG. 1; there may be three other walls. It may be preferable for the bedroom walls to have complimentary features to those selected for section E/F.

It may also be preferred to match, or not match, the features for other sections as well. For example, section B/C represents a kitchen type area with certain features. The wall opposite section B/C, which is not depicted in the figures, can have the same features or different features.

Typically, the template 12 is in electronic form, but if it is in hard copy form, it can be scanned into a computer so that it is in electronic form. In the computer, the template 12 can be displayed on a monitor. The sections of the wall can be linked together in whole or broken into individual parts for purposes of adding features to the wall. In the preferred embodiment, the sections are considered individual parts for which separate features are added.

The designer can select from an almost unlimited variety of preprogramed colors, designs and/or patterns to apply to the various areas. The colors, designs and/or patterns are referred to herein as features 32.

Figure 2:
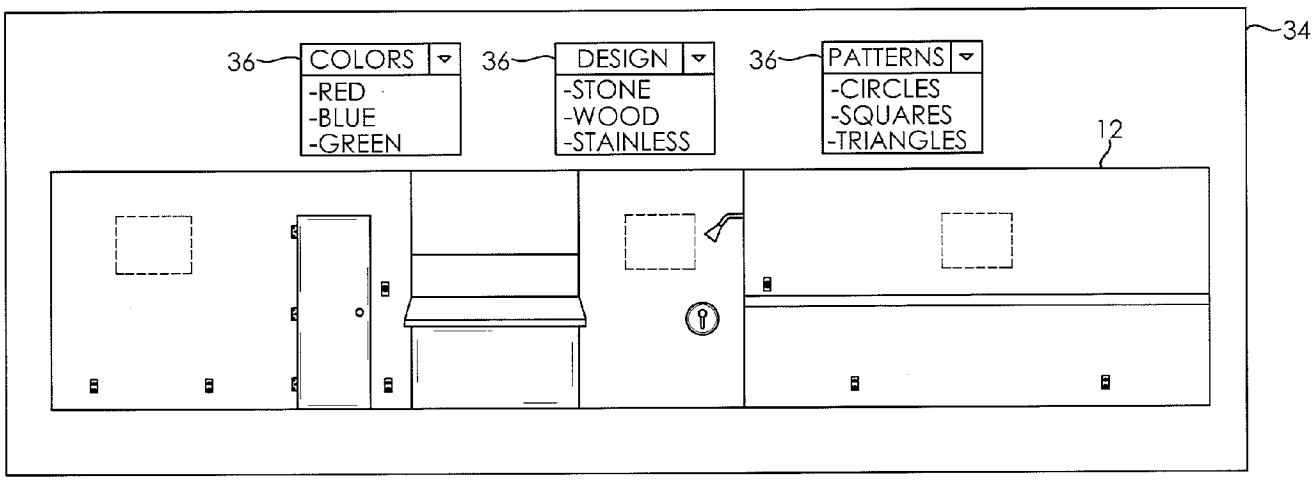
FIG. 2 is a schematic representation of the template from FIG. 1 depicted on a computer screen with menus for features.

FIG. 2 depicts one embodiment of a computer screen 34 with the template 12 of FIG. 1 depicted thereon. FIG. 2 also depicts menus 36, such as pull down menus, for various features. In the depicted embodiment, features 32 such as color, designs and patterns are depicted in the menus 36. The present invention is not limited to only these features 32, or the sub-features identified for each of the features. Instead, additional features and sub-features than what is depicted in FIG. 2 may be used.

FIG. 2 depicts menus 36 for color, design and pattern features. Sub-features for color include, by way of example, the colors red, blue and green. Sub-features for a design include a stone design, a wood design and a stainless steel design, by way of example. Sub-features for a pattern may include, for example, circles, square and triangles. The sub-features might be preprogramed and comprise popular colors, designs and patterns. Additionally, the user may create their own color, design or patterns combinations rather than select from the preprogramed options.

Figure 3:
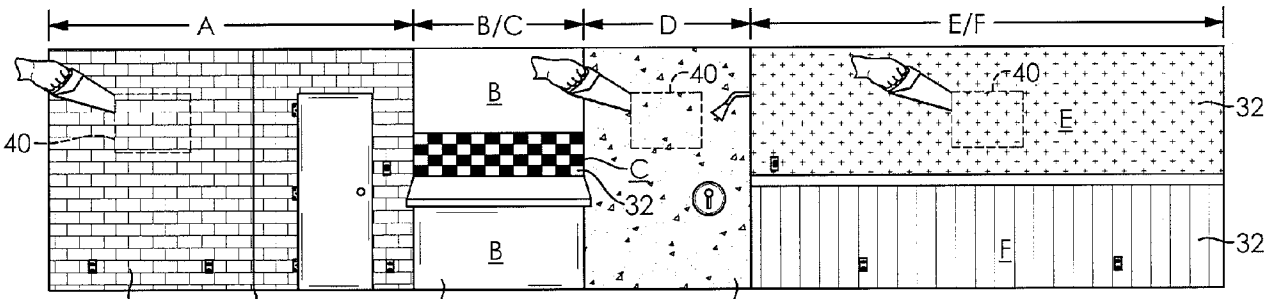
FIG. 3 is a schematic representation of the template of FIG. 2 with features in selected areas of the template.

FIG. 3 depicts one embodiment wherein colors, designs and patterns have been selected or created and applied to the various sections of the template 12. By way of example, section A may be a red brick design, section B may be a color, section C may be a multi-colored tile backsplash pattern, section D may be a grey granite design, and section E may be a red cross pattern and section F may be a brown knotty pine design.

The colors, designs and/or patterns may be applied in any amount and/or degree and manipulated in any fashion on the electronic template. Various versions of the wall with the features may be created, saved or deleted in computer memory. The completed template may be saved in computer memory, displayed on a monitor and/or printed to provide to an end user.

Figure 4:
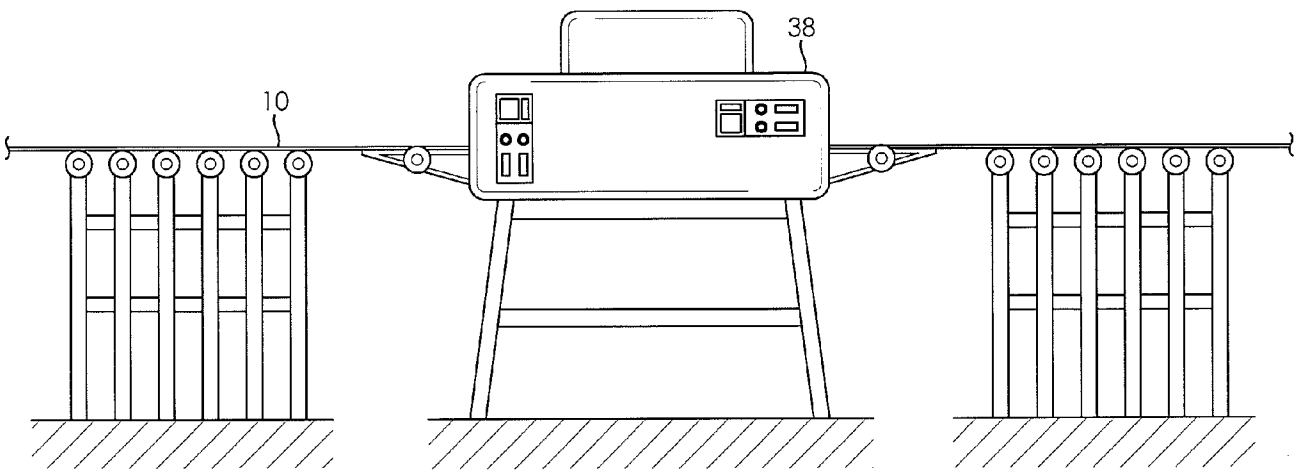
FIG. 4 is a schematic representation of a substrate in an image machine for locating an image on the substrate.

A substrate 10, such as a continuous length of FRP, is loaded into an imager as seen in FIG. 4. The imager 38 may be such as a Durst Rho 800, but other imagers may also be used. A Durst Rho may be obtained from Durst Phototechnik AG in Brixen, Italy.

The substrate 10 may be long enough to entirely cover the wall at its ultimate installation location or it may be long enough for just a section or sections of the wall. The following will describe using just a section of a wall.

The completed template that has been saved in computer memory is sent to the imager 38. The imager 38 is programed to image the various colors, designs and/or patterns onto the substrate according to the completed template. For example, the imager 38 images section A as seen in FIG. 3.

The imager 38 may be programed to avoid imaging, but at least outline, certain areas of the section. These areas might comprise the interior wall openings 30 described above. A border 40 may be provided around the interior wall openings 30 so that the substrate 10 can be cut to accommodate them. The border 40 can comprise dashed and/or dotted lines added to the substrate 10 by the imager 38 to highlight where the interior wall openings 30 need to be located. The imaged substrate 10 can be cut along the dashed/dotted lines to accommodate these features. The cutting can be accomplished via hand tools and/or power tools. The portion of the imaged substrate in front of the planned window, electrical outlet, hinge, door, etc. can be removed thus revealing these objects.

After the substrate 10 is imaged and either before or after any interior wall openings 30 are removed, it may be preferable to provide at least one coating over the imaged substrate 10 to protect it from scratches, abrasions, to increase its mildew resistance, to make it easy to clean, to make it waterproof, to protect the imaged color, pattern and/or design, to increase its strength, to increase its resistance to fire, to function as a smoke inhibitor and/or provide it with a sheen or shine.

Many different coatings are commercially available to accomplish one or more of the foregoing. One coating that has been found to be advantageous is Marashield, a UV screen printing coating available from Marabu of Tamm, Germany.

The imaged substrate 10 or substrates can then be located directly onto the wall. The location can be such as through mechanical fasteners, adhesives, friction fittings and/or male/female type couplings.

The interior wall openings being pre-located on the substrate facilitates installation of the imaged substrate. Namely, the imaged pattern about the interior wall opening provides its exact size, shape and location. An installer merely has to cut along the imaged pattern to provide access to the existing electrical outlets, hinges, windows, doors, etc. that are already in place behind the imaged substrate. The imaged substrate thus fits exactly about the existing structures on the wall and permits the features on the imaged substrate to be directly adjacent the existing structures. For structures such as electrical outlets or electrical switches, the imaged substrate can entirely surround the outlet or switch without interruption or a break. This leads to a continuous, uninterrupted appearance of the imaged features.

Based on the above, it can be appreciated that window trim, which is typically comprised of wooden strips that are separately added about the perimeter of a window, can be imaged about the interior wall opening the substrate. There is no longer any need for the separately added strips, when the image of the strips can be located on the substrate and the opening for the window located within the inner border of the imaged trim. It can be appreciated that the same technique can be used for door trim, moulding, electrical outlet covers and electrical switch covers, as well as framed artwork.

If more than one substrate 10 is used, the substrates 10 can be assembled so that their respective patterns, designs or colors match. The assembly can be to the wall or first in a jig where they are matched and connected and then assembled to the wall.

When an area comprises one or more substrates 10, or where two areas meet one another, it may be difficult for the edges of respective substrates 10 to be assembled so that the design, color and/or pattern have a continuous, uninterrupted appearance between the two imaged substrates 10. In that instance, or for any other reason, a connector strip 42 may be used to connect the two substrates 10 together so that the design, color and/or pattern shared by the substrates have a continuous appearance. One example of an area where two substrates that share a common feature and that are located adjacent one another in a single area is depicted in Section A of FIG. 3 at reference number 44. While a single joint 44 between two substrates is shown in FIG. 3, it can be appreciated that additional joints may be located in the same area or areas.

Figure 5:
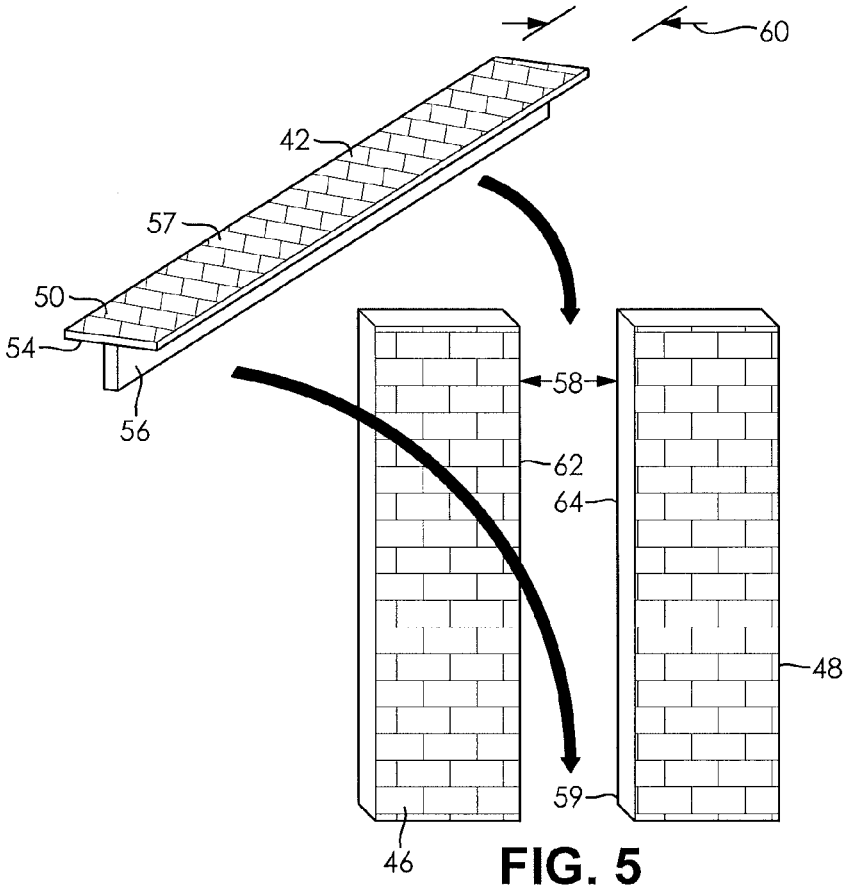
FIG. 5 is a schematic representation of a gap between two adjacent substrates and a T-strip ready for location within said gap.
Figure 6:
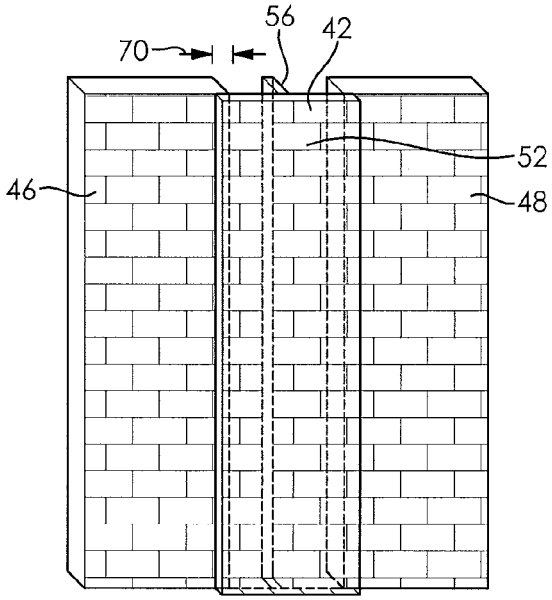
FIG. 6 is a schematic representation of the T-strip of FIG. 5 located in the gap between the substrates.

In a preferred embodiment, a T-strip connector 42 is located between a first substrate 46 and a second substrate 48, as schematically depicted in FIGS. 5 and 6. The connector 42 has a cross-section that is generally T-shaped with a top flange 50 having an upper 52 and a lower surface 54 and a web 56 extending generally transverse to the top flange 50 and centered on the lower surface 54. The upper surface 52 of the top flange 50 is generally planar; the lower surface 54 of the top flange 50 is also planar except for the web 56. The web 56 is preferably integrally formed with the top flange 50, but the two may be separately formed and joined by adhesive, welding, male/female connections or the like.

In order to give the joined substrates the appearance of continuity, it is preferred that the upper surface 52 of the T-strip 42 is imaged with a color, pattern and/or design that is the same as at least one of the adjacent substrates 46, 48, preferably both of the substrates 46, 48. It is also preferred that the pattern and/or design that is imaged on the T-strip 42 takes into account the width 58 of the gap 59 between the substrates 46, 48, the width 60 of the top flange 50 of the strip 42 and at least the distance 70 the strip 42 overlaps on the imaged substrates 46, 48. Taking these dimensions into account ensures that the pattern or design has a continuous, uninterrupted appearance extending from one substrate 46, across the T-strip 42, to the second substrate 48. The dimensions ensure that the T-strip 42 does not distort, elongate, shorten or otherwise change the pattern and/or design.

The imaged T-strip 42 is located between the two substrates 46, 48. More particularly, the web 56 is located between edges 62, 64 of the two substrates 46, 48 and the lower surface 54 of the top flange 50 is located against upper surfaces 66, 68 of the two substrates 46, 48. The strip 42 preferably extends in the gap 59 along the entire height of the two substrates 46, 48 in a continuous, uninterrupted fashion. The top flange 50 thickness is relatively small and is in the range of approximately 1-3 millimeters.

The strip 42 may be held in place by the frictional interaction between the web 56 and the edges of the substrates 46, 48. Additionally, or alternatively, adhesives, mechanical fasteners or other means may be used to temporarily or permanently affix the strip 42 to the substrates 44, 46.

Based on the foregoing, a lightweight, highly decorative and customizable interior panel is produced. The panel is quick and easy to produce and install, and may be done so at a low cost. The lightweight nature of the panel saves weight in the vehicle and may result in reduced fuel consumption.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A method of creating an interior wall panel, comprising:

providing an electronic template for an interior wall, said template defining at least one interior wall opening;

selecting at least one feature for all or part of said wall, said at least one feature is selected from the group of a color, a design and a pattern;

imaging said at least one feature on all or part of a first substrate at the same time that said at least one interior wall opening is imaged on said substrate;

imaging another at least one feature on a second substrate;

locating said imaged substrates adjacent one another on an interior wall of a residential structure;

removing said at least one interior wall opening from said first substrate;

imaging the same said at least one feature that is on both said first and second substrates on the top flange of a T-shaped strip; and locating a web of said T-shaped strip between said first and second substrates so that said imaged top flange of said T-shaped strip continues said at least one feature between said substrates.

2. The method of claim 1, wherein said template defines areas of said interior wall, said areas selected from the group of a kitchen area, a shower area, a living area and a sleeping area.

3. The method of claim 1, wherein said at least one feature is located within said areas of said interior wall within said template.

4. The method of claim 1, wherein said at least one feature comprises multiple features located adjacent one another, said multiple features differing from one another.

5. The method of claim 1, wherein said at least one interior wall opening is selected from the group of an electrical outlet, a light switch, a window, a door and a plumbing fixture.

6. The method of claim 1, further comprising imaging said at least one interior wall opening on said second substrate at the same time that said at least one feature is imaged on said second substrate.

7. The method of claim 1, wherein said first substrate and said second substrate is fiberglass reinforced plastic.

8. The method of claim 1, wherein said template defines different areas and different interior wall openings, wherein different features are selected for each of said areas, wherein said different features for each of said areas are imaged on said first substrate and said second substrate at the same time that said different interior wall openings are imaged on said substrates.

9. The method of claim 1, wherein said interior wall is selected from the group of a recreational vehicle interior wall, a mobile home interior wall, and a modular home interior wall.

10. The method of claim 1, wherein said imaged substrates are coated with a coating for abrasion resistance.

11. The method of claim 1, wherein said T-strip extends the height of said substrates installed as said interior wall.

12. The method of claim 11, wherein a bottom surface of said T-strip top flange lays flat against outer surfaces of said substrates.

13. The method of claim 1, further comprising determining the width of said top flange of said T-strip and modifying said at least one feature so that it is imaged taking said T-strip top flange width into account to provide a continuous image between said T-strip and said substrates.

14. A method of creating an interior wall panel, comprising;

imaging at least one feature on all or part of a first substrate at the same time that at least one interior wall opening is imaged on said substrate;

imaging the same at least one feature on a second substrate;

imaging the same at least one feature on the top surface of a top flange of a T-strip;

locating said imaged, coated substrates adjacent one another on an interior wall of a residential structure;

removing said at least one interior wall opening from said substrate;

locating said imaged T-strip between said substrates;

locating a web of said T-shaped strip between said first and second substrates so that said imaged top flange of said T-shaped strip continues said at least one feature between said substrates.

15. The method of claim 14, wherein said at least one feature is selected from the group of a color, a design and a pattern.

16. The method of claim 14, wherein said template defines areas of said interior wall, said areas selected from the group of a kitchen area, a shower area, a living area and a sleeping area.

17. The method of claim 14, wherein said at least one feature is located within said areas of said interior wall within said template.

18. The method of claim 14, wherein said at least one interior wall opening is selected from the group of an electrical outlet, a light switch, a window, a door and a plumbing fixture.

19. The method of claim 14, wherein said T-strip extends the height of said substrates installed as said interior wall.

20. The method of claim 19, wherein a bottom surface of said T-strip top flange lays flat against outer surfaces of said substrates.

21. The method of claim 14, further comprising determining the width of said top flange of said T-strip and modifying said at least one feature so that it is imaged on said substrate taking said T-strip top flange width into account to provide a continuous image between said T-strip and said substrates.

* * * * *